US008505892B2

(12) United States Patent
Seidel

(10) Patent No.: US 8,505,892 B2
(45) Date of Patent: Aug. 13, 2013

(54) BAR CLAMP ASSEMBLY AND WORKPIECE SUPPORT MEMBERS

(76) Inventor: Charles Seidel, Royal Oak, MI (US)

( * ) Notice: Subject to any disclaimer, the term of this patent is extended or adjusted under 35 U.S.C. 154(b) by 407 days.

(21) Appl. No.: 12/907,230

(22) Filed: Oct. 19, 2010

(65) Prior Publication Data

US 2011/0089621 A1 Apr. 21, 2011

Related U.S. Application Data

(60) Provisional application No. 61/252,766, filed on Oct. 19, 2009.

(51) Int. Cl.
*B25B 11/00* (2006.01)

(52) U.S. Cl.
USPC ..... 269/46; 269/3; 269/6; 269/249

(58) Field of Classification Search
USPC ..... 269/46, 166, 165, 171, 3, 6, 95
See application file for complete search history.

(56) References Cited

U.S. PATENT DOCUMENTS

| | | | | |
|---|---|---|---|---|
| 4,552,345 | A | 11/1985 | Benda et al. | |
| 5,443,246 | A | 8/1995 | Peterson | |
| 6,050,559 | A * | 4/2000 | de Souza | 269/208 |
| 6,848,683 | B2 | 2/2005 | Foshag et al. | |
| 7,600,744 | B2 * | 10/2009 | Liou | 269/166 |
| 7,681,870 | B2 * | 3/2010 | Ben-Gigi | 269/6 |
| 8,079,123 | B2 * | 12/2011 | Lin | 29/259 |
| 8,282,088 | B2 * | 10/2012 | Janson et al. | 269/6 |
| 2001/0006270 | A1 * | 7/2001 | Baculy | 269/166 |
| 2010/0327504 | A1 * | 12/2010 | Seidel | 269/43 |
| 2011/0089621 | A1 * | 4/2011 | Seidel | 269/46 |

FOREIGN PATENT DOCUMENTS

| | | |
|---|---|---|
| JP | 6-8149 | 1/1994 |

* cited by examiner

*Primary Examiner* — Lee D Wilson
(74) *Attorney, Agent, or Firm* — McPherson IP Law Office

(57) ABSTRACT

The present invention relates to bar clamp assemblies and workpiece support members configured for use with bar clamp assemblies. In one aspect, the present invention provides a workpiece support member for a bar clamp assembly. The workpiece support member include a base including an engagement feature configured for engagement with a guide rail of the bar clamp assembly. The workpiece support member also includes a first finger extending from the base and a second finger extending from the base. The first and second fingers are disposed apart with respect to one another to form a slot having a substantially continuous width. The first, second or both fingers form an abutment surface and a support surface, the abutment surface and the support surface are generally perpendicular with respect to one another.

20 Claims, 5 Drawing Sheets

BAR CLAMP ASSEMBLY AND WORKPIECE SUPPORT MEMBERS

CROSS-REFERENCE TO RELATED APPLICATIONS

The present application claims benefit of U.S. Provisional Patent Application No. 61/252,766, filed Oct. 19, 2009, the contents of which are hereby incorporated by reference in its entirety for all purposes. The present application is also related to and is an extension of commonly owned co-pending U.S. Non-provisional patent application Ser. No. 12/493,230, filed Jun. 28, 2009, the contents of which are hereby incorporated by reference in its entirety for all purposes.

FIELD OF THE INVENTION

The present invention relates to bar clamp assemblies, workpiece support members and clamp systems for clamping and support of workpieces.

BACKGROUND

Clamps are often used in the woodworking field to join and hold components together while adhesives and/or fasteners are used to maintain the components together. One particular group of clamps that are often used includes the arm, body or bar clamp or other similar type clamp, hereinafter referred to as bar clamps. The bar clamp includes a moveable member, such as a slide jaw, configured to move along a length of the bar clamp, such as along a guide rail, to cause compression or squeezing of components of a workpiece. This compressive force is the result of the moveable member compressing the components against an opposing member, such as a fixed jaw, of the bar clamp. The opposing member is suitable in strength to allow a substantial amount of compressive force to be applied to the components of the workpiece. Such compressive force is desired, and often needed, to ensure that the components are properly joined and aligned during fastening of the same.

In certain applications it has become advantageous to generate compressive forces in multiple directions with respect to components of a workpiece. For example, with continued reference to the bar clamp, at times it is advantageous to generate forces both longitudinally along the length of the bar clamp as well as laterally, i.e. generally perpendicular to the longitudinal force, to ensure that the components maintain position with respect to one another during attachment. In this regard, few manufactures have developed products capable of generating multiple forces onto a workpiece, particularly with respect to bar clamps. In the only known instance, an edge clamp, that is attachable to the bar clamp and able to generate a force generally perpendicular with respect to the compressive forces generated along a length of the bar clamp, is available for purchase, separate from the bar clamp. However, these edge clamps provide little more function than a positioning means for a workpiece as the clamps are incapable of substantial compressive force, as compared to the compressive force generated along the length of the bar clamp. This is due to the lack of support or counterforce acting upon the workpiece as the edge clamp applies the lateral compressive force to the workpiece. At best, the only resistance to the edge clamp is the friction force generated between the components of the workpiece and the bar clamp. Accordingly, as soon as the compressive force of the edge clamp overcomes the friction force, the components of the workpiece moves away from the bar clamp thereby rendering the edge clamp ineffective for applying meaningful compressive force.

In one particular application, it has been discovered that existing bar clamps, along with edge clamps, are ineffective for joining longer and wider workpiece components together, such as boards, panels or otherwise. This is due to the inability of the bar clamp to generate suitable lateral compressive force, as described above. Accordingly, should one desire to form a multi-layered panel, such as a plywood board or the like, they are required to purchase specialized clamps, which incurs cost for the additional tool and added steps to the overall production of a final workpiece. This is particularly problematic when attaching veneer to a base board, wherein a particular wood finish is desired.

In another aspect, with the exception of the use of a side clamp, prior bar clamps have been one dimensional with respect to clamping forces. This is because the only clamping force provided is between a slide jaw and fixed jaw of the bar clamp. If additional clamping forces are desired, whether on the same workpiece or a different workpiece, additional clamps must be used, which can be costly and cumbersome in use.

In view of the foregoing, there is a need for methods and devices for improving available clamping forces onto a workpiece. More so, there is a need for an improved bar clamp assembly capable of providing improved multiple compressive forces to a workpiece, particularly at least one suitable force that is generally perpendicular to compressive force applied along a length of the bar clamp.

SUMMARY OF THE INVENTION

The present invention provides additional utilities and advantages to new and existing bar clamp assemblies. In one aspect, the present invention provides support members for a workpiece that is attached to an existing bar clamp assembly and which is suitable in strength to resist movement of the workpiece upon application of a load, such as with side clamps. In another aspect, the present invention provides support members for a bar clamp assembly that are capable of providing support to additional workpieces other than the workpieces being engaged by the bar clamp assembly. In still another aspect, the present invention provides support members, for a bar clamp assembly, having additional clamps for engaging the same or different workpiece than is being engaged by the bar clamp assembly. In still another aspect, the present invention provides a clamp system for generating compression over a large area of a workpiece with the use of bar clamp assemblies. It will become apparent that other utilities and advantages exist with the present invention.

In one embodiment, the present invention provides a workpiece support member for a bar clamp assembly. The workpiece support member includes a base having an engagement feature configured engagement with a guide rail of a bar clamp assembly. The workpiece support member further includes a first finger extending from the base and a second finger extending from the base, wherein at least one of the first or second fingers include a first workpiece abutment surface and a first workpiece support surface. The first and second fingers are disposed apart with respect to one another to form a slot for receiving the rail of the bar clamp assembly.

In another embodiment, the present invention provides a bar clamp assembly including a bar clamp configured for engagement with a workpiece. The bar clamp includes a guide rail extending along an axis between a first end and a second end. The bar clamp also includes a slide jaw disposed along the guide rail and a fixed jaw attached to the guide rail proximate the first or second end. The slide jaw is moveable with respect to the fixed jaw to compress a workpiece. The bar clamp assembly further includes a first workpiece support member disposed proximate the slide jaw. The first workpiece support member includes a base having an engagement feature configured for engagement with the guide rail, a pair of fingers extending from the base, the pair of fingers including a workpiece abutment surface and a workpiece support surface, and a first clamp moveable with respect to the base, the clamp being configured for engagement with a workpiece. The bar clamp further includes a second workpiece support member disposed proximate the fixed jaw. The second workpiece support member includes a base having an engagement feature configured for engagement with the guide rail, a pair of fingers extending from the base, the pair of fingers including a workpiece abutment surface and a workpiece support surface, and a second clamp moveable with respect to the base, the clamp being configured for engagement with a workpiece.

In still another embodiment, the present invention provides a clamp system for joining multiple layers of a workpiece. The clamp system includes a plurality of bar clamp assemblies. Each of the plurality of bar clamp assemblies includes: i) a guide rail extending along an axis between a first end and a second end, ii) a slide jaw disposed along the guide rail and a fixed jaw attached to the guide rail proximate the first or second end, the slide jaw being moveable with respect to the fixed jaw to compress a workpiece, and iii) a first workpiece support member disposed proximate the slide jaw and a second workpiece support member disposed proximate the fixed jaw. The first and second workpiece support members include a base having an engagement feature configured engagement with the guide rail and a pair of fingers extending from the base, the pair of fingers including a workpiece abutment surface and a workpiece support surface, The clamp system further includes one or more spindle clamps threadably engaged with a cross member that is engaged with the guide rails of the plurality of bar clamp assemblies. The one or more spindle clamps are moveable towards a workpiece that is supported by the support surfaces of the first and second workpiece support members.

The above-described and other features and advantages of the present invention will be appreciated and understood by those skilled in the art from the following detailed description, drawings, and appended claims.

BRIEF DESCRIPTION OF THE DRAWINGS

Other objects, features, advantages and details of the present invention appear, by way of example only, in the following detailed description of preferred embodiments of the invention, the detailed description referring to the drawings in which.

DESCRIPTION OF THE PREFERRED EMBODIMENTS

The present invention provides methods and devices for forming and maintaining even pressure against one or more components of a workpiece. The application of pressure is particularly advantageous during assembly of components to form a final product, or subcomponent thereof, wherein during application of pressure the components are fixedly attached to one another through any suitable attachment means, e.g., fasteners, adhesives or otherwise. Upon attachment, the pressure is discontinued and the components are maintained together through the attachment means.

In one particular configuration, the above referenced methods and device are derived through an improved bar clamp assembly including a workpiece support member. It should be appreciated that the bar clamp assembly may comprise, without limitation, clamps having a first jaw moveable along a guide rail, bar, rod or the like, and a second fixed jaw that is fixedly attached or integrally formed with the guide rail. Accordingly, such clamps may comprise bar clamps, jaw clamps, body clamps or other similar clamps. The bar clamp assembly is configured to generate a first compressive force along a length of the bar clamp assembly and at least one other compressive force that is generally perpendicular to the first compressive force. In this configuration, the bar clamp includes a first moveable member, such as a slide jaw, and a first opposing member, such as a fixed jaw, that act to compress a workpiece along a guide rail axis. The bar clamp assembly may further include a second moveable member, such as an edge or other clamp such as described herein or otherwise, and a second opposing member, such as the workpiece support member, that acts to compress a workpiece along a second axis that is non-parallel to the first axis or even generally perpendicular to the first axis. It should be appreciated that additional moveable members and opposing members may be utilized.

Figure 1:
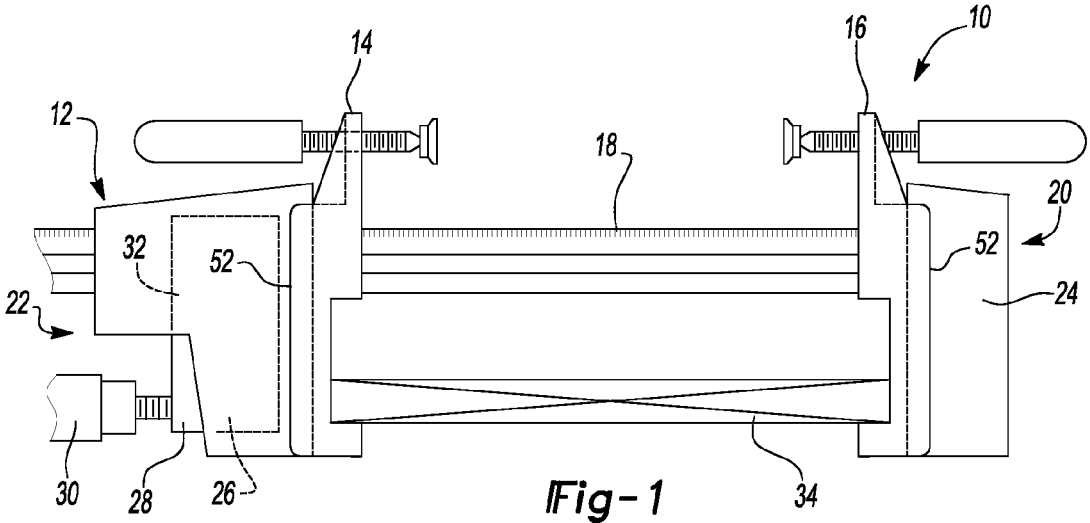
FIG. 1 illustrates an exemplary embodiment of a bar clamp assembly according to the teachings of the present invention.
Figure 2:
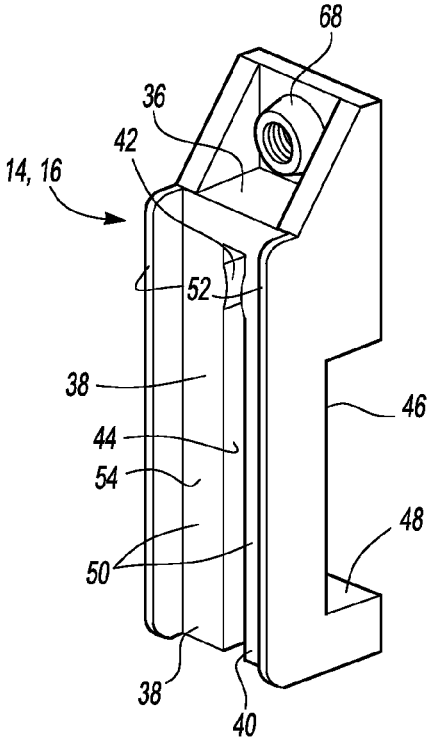
FIG. 2 illustrates a perspective view of a workpiece support member shown in FIG. 1.
Figure 3:
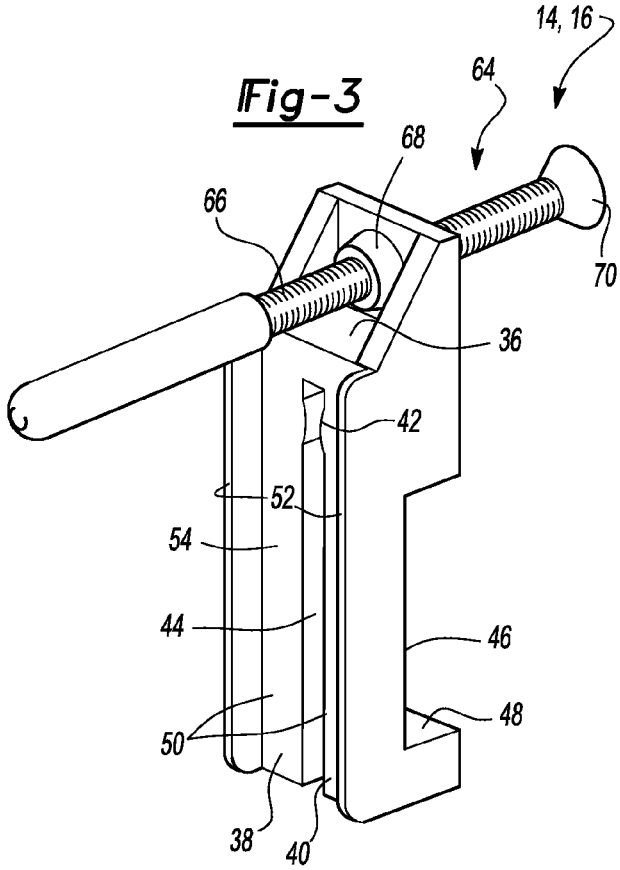
FIG. 3 illustrates a perspective view of a workpiece support member including a threaded spindle clamp shown in FIG. 1.
Figure 4:
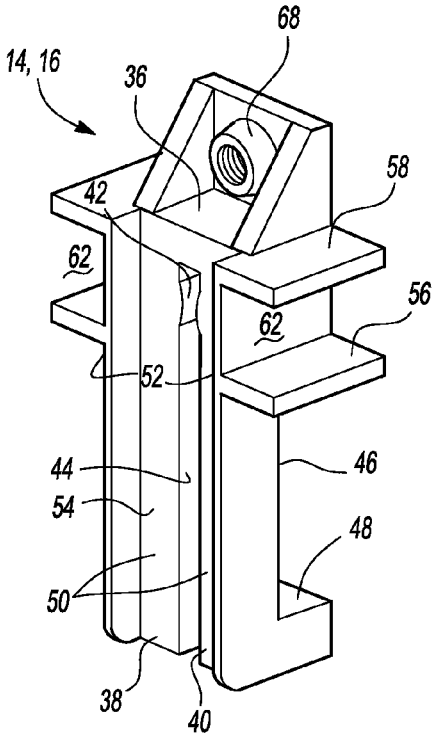
FIGS. 4 and 5 illustrate perspective views of another workpiece support member according to the teachings of the present invention.
Figure 5:
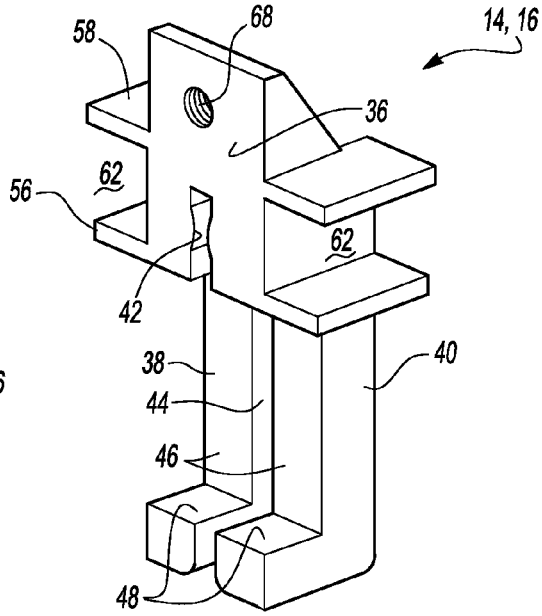
Figure 6:
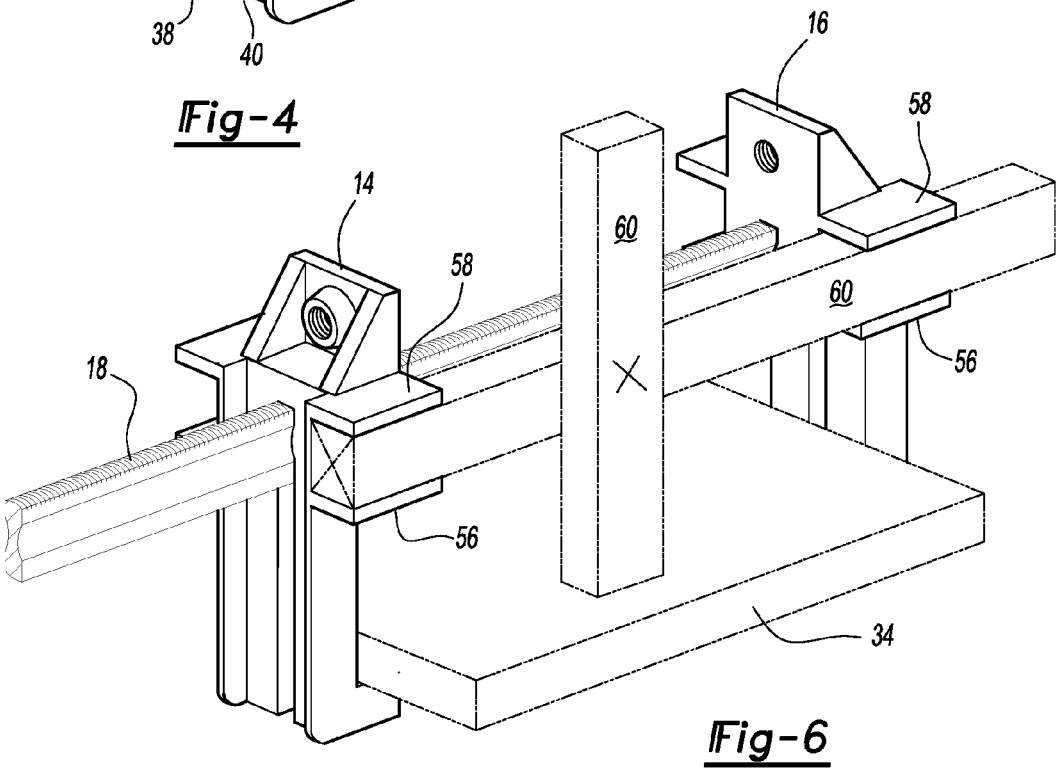
FIG. 6 illustrates the workpiece support members shown in FIGS. 4 and 5 engaging several workpieces.
Figure 7:
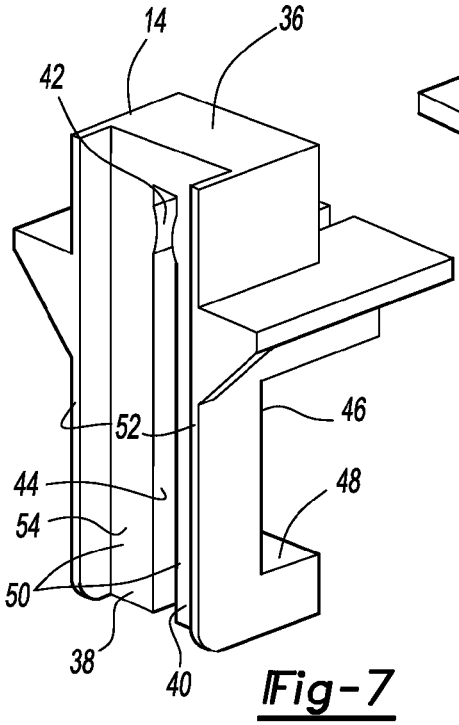
FIGS. 7 and 8 illustrate perspective views of yet another workpiece support member according to the teachings of the present invention.
Figure 8:
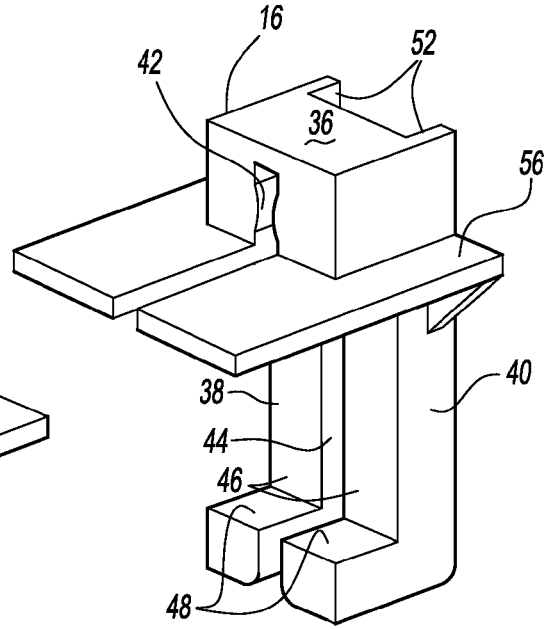
Figure 9:
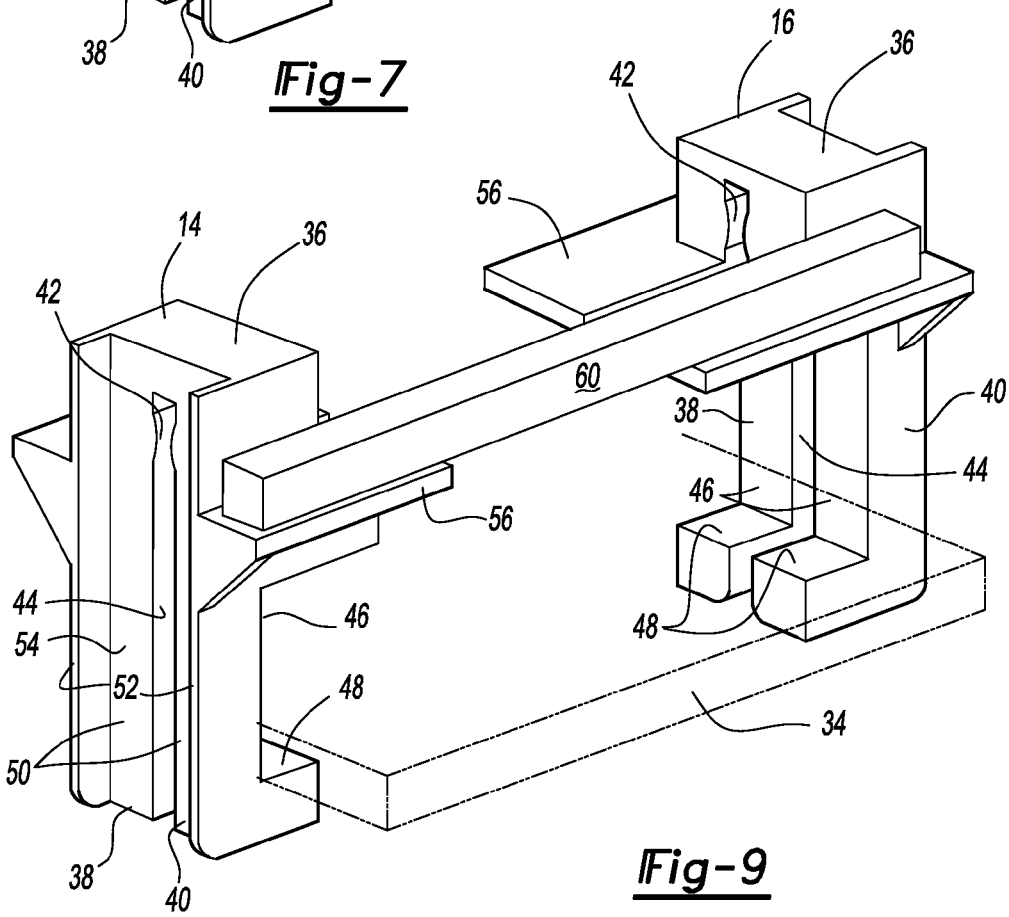
FIG. 9 illustrates the workpiece support members shown in FIGS. 7 and 8 engaging several workpieces.

Referring to FIG. 1, a first embodiment of a bar clamp assembly 10 is shown. The bar clamp assembly 10 includes a bar clamp 12, a first workpiece support member 14 and a second workpiece support member 16. The bar clamp 12 includes a guide rail 18 extending along an axis 'A' between a first end 20 and a second end 22. The bar clamp also includes a fixed jaw 24 disposed and fixedly attached to the first end 20 of the guide rail 18. The bar clamp 12 further includes a slide jaw 26 slidably disposed at or between the first and second end 20, 22 of the guide rail 18. The bar clamp 12 still further includes a compress mechanisms 28 configured for causing movement of the slide jaw 26 with respect to the fixed jaw 24. In this configuration, the compress mechanism comprises a threaded spindle 30 engaged with a rail engagement member 32 configured for engagement with the guide rail. Upon rotation, the threaded spindle 30 engages and causes movement of the slide jaw 26 with respect to the fixed jaw 24 to cause engagement or disengagement of a workpiece 34.

Referring to FIGS. 2 through 9, several exemplary embodiments of the first and second workpiece support members 14, 16 are shown. The first and second workpiece support members 14, 16 are useable with not only bar clamp 12 shown in FIG. 1, but also with other bar clamps or similar type clamps and may be alternatively shaped to engage the particular slide jaw 26 and fixed jaw 24 of the bar clamp assembly 10. Accordingly, it is contemplated that in one exemplary embodiment the workpiece support members 14, 16 are disposed proximate the slide jaw 26 and fixed jaw 24 of the bar clamp assembly 10 and are configured for providing an abutment surface and a support surface to a workpiece during clamping by the bar clamp assembly 10.

The workpiece support members 14, 16 include a base 36 and one or more fingers extending from the base member for providing the abutment and support surface for a workpiece. In the configuration shown, the workpiece support members 14, 16 include a first finger 38 and a second finger 40 extending from, and below, base 36. The workpiece support members 14, 16 also include an engagement feature 42 configured for engagement with the guide rail 18 of the bar clamp assembly 10. In one embodiment, the engagement feature 42 includes a corresponding shape to the guide rail 18. In still another embodiment, the engagement feature 42 comprises a snap-fitting for maintaining engagement of the first and second workpiece support members 14, 16 with the guide rail 18. The engagement feature 42 is suitable in size and shape to allow sliding movement of the workpiece engagement member 14, 16 along the guide rail 18. In one exemplary embodiment, the first and second fingers 38, 40 are disposed apart from one another to form a first slot 44 for receiving the guide rail into the engagement feature 42.

As previously indicated, the first and second fingers 38, 40 may be configured for providing the abutment and support of a workpiece for the workpiece support members 14, 16. Accordingly, in one exemplary embodiment, the first and second fingers 38, 40 include an abutment surface 46 for bestowing a compressive force to the workpiece 34, via the compress mechanism 28. Also, the first and second fingers 38, 40 include a support surface 48 for supporting a workpiece before, during and/or after compression of the workpiece. The support provided by the workpiece support members 14, 16 includes support for the weight of the workpiece and may also include counter-force support of the workpiece during application of force by a side clamp or otherwise. Preferably, the length, width and/or area of the abutment surface and support surface are sufficient for providing sufficient support of the workpiece.

In one exemplary embodiment, it is contemplated that the abutment surface 46 is substantially flat for positive engagement with a corresponding flat surface of a workpiece. Similarly, in one exemplary embodiment it is also contemplated that the support surface 48 is substantially flat for positive engagement with a corresponding flat surface of a workpiece. In one configuration, the abutment surface 46 is generally perpendicular to the support surface 48.

The first and second workpiece support members 14, 16 are also configured for abutting engagement with the fixed jaw 24 and slide jaw 26 so that the workpiece support members do not move, with respect to the fixed jaw and slide jaw, during compression. Preferably, an positive engagement is formed between the first and second workpiece support members 14, 16 and jaws 24, 26 such that movement of the fixed jaw and slide jaw are mirrored by the first and second workpiece support members. In one embodiment, the first and second workpiece support members 14, 16 (i.e. base 36, first finger 38 and/or second finger 40) include a corresponding surface, i.e. mirrored or otherwise, to a surface of the fixed jaw 24 and/or slide jaw 26. For example, in one configuration, the first and second workpiece support members 14, 16 include a jaw surface 50, opposite the abutment surface 46, that is generally flat, which allows the first and second workpiece support members 14, 16 to reside flush with the fixed jaw 24 or slide jaw 26.

In one embodiment, the first and second workpiece support members 14, 16 are configured for enhanced engagement between the first and second workpiece support members 14, 16 and the fixed and slide jaws 24, 26. In one exemplary embodiment, this enhanced engagement takes the form of one or more lip members 52, located adjacent jaw surface 50, extending away from the first and second fingers 38, 40 in a direction opposite abutment surface 46. In one particular embodiment, the first and second workpiece support members 14, 16 include lip members 52 located on opposite sides to form a second slot 54 for receiving at least a portion of the fixed jaw 24 or slide jaw 26. Further, the slot 54 formed by the first and second workpiece support members 14, 16 include a corresponding shape to the fixed jaw 24 and slide jaw 26 to form a solid engagement between the workpiece support members and fixed and slide jaws. In one configuration, a friction fit is formed between the first and second workpiece support members 14, 16 and the fixed and slide jaws 24, 26.

Referring to FIGS. 4 through 9, in one exemplary embodiment the first and second workpiece support members 14, 16 include one or more additional supports for supporting and controlling movement of one or more additional workpieces 60. Such additional workpieces may be subsequently attached to the workpiece 34 being secured by the clamp assembly 10 or may be used for other assembly purposes such as the mounting or support of additional clamps or otherwise. In one configuration, the additional supports comprises a first additional support member 56 and/or a second additional support member 58. As shown, the first and second additional support members 56, 58 may extend forward, backwards and/or to the sides of base 36 and/or the first and second workpiece support members 14, 16. In one embodiment, a first support member 56 and a second support member 58 are provided adjacent to one another and on opposite sides of base 36, which forms a third slot 62 for receiving the additional workpiece 60. Advantageously, the third slot 62 is particularly useful for controlling vertical movement of the additional workpiece 60.

In yet another exemplary embodiment, referring to FIGS. 1 through 6, it is further contemplated that the first and second workpiece support members 14, 16 include one or more clamping features 64 for engagement of yet another additional workpiece 60. In one configuration, the additional clamping feature comprises a threaded spindle 66 engaged with a corresponding threaded member 68 extending from a top portion of the first or second workpiece support member 14, 16, such as base 62. In this configuration, upon rotation of threaded spindle 66, a workpiece engagement member 70 of the threaded spindle 66 moves towards or away from a corresponding workpiece to provide for additional clamping to a workpiece, such as to additional workpiece 60. The fixed jaw 26 and slide jaw 28 provide reactionary counterforce to any pressure exerted on the additional workpiece by the clamping feature 64. However, it should be appreciated that other additional clamping configurations and mechanisms are possible.

The first and second workpiece support members 14, 16 may be formed of any suitable material. Preferably, the material is suitable in strength to provide desired reactionary force to clamps mounted to or along guide rail 18, such as a side clamp. Non-limiting examples of suitable material include metal, plastic or a combination thereof. In one configuration, the plastic is reinforced or otherwise comprises a high strength plastic. Such reinforcement may be achieved through a strengthening member extending through the workpiece support member or may comprise fibers, resins or other additives for imparting strength to the workpiece support member. In one particular example, the features of the first and second workpiece support members are integrally formed to form unitary structures. The first and second workpiece support members may be formed through any suitable process for forming metal or plastic components. In one configuration, the first and second workpiece support members are molded to form integrally formed structures.

Figure 10:
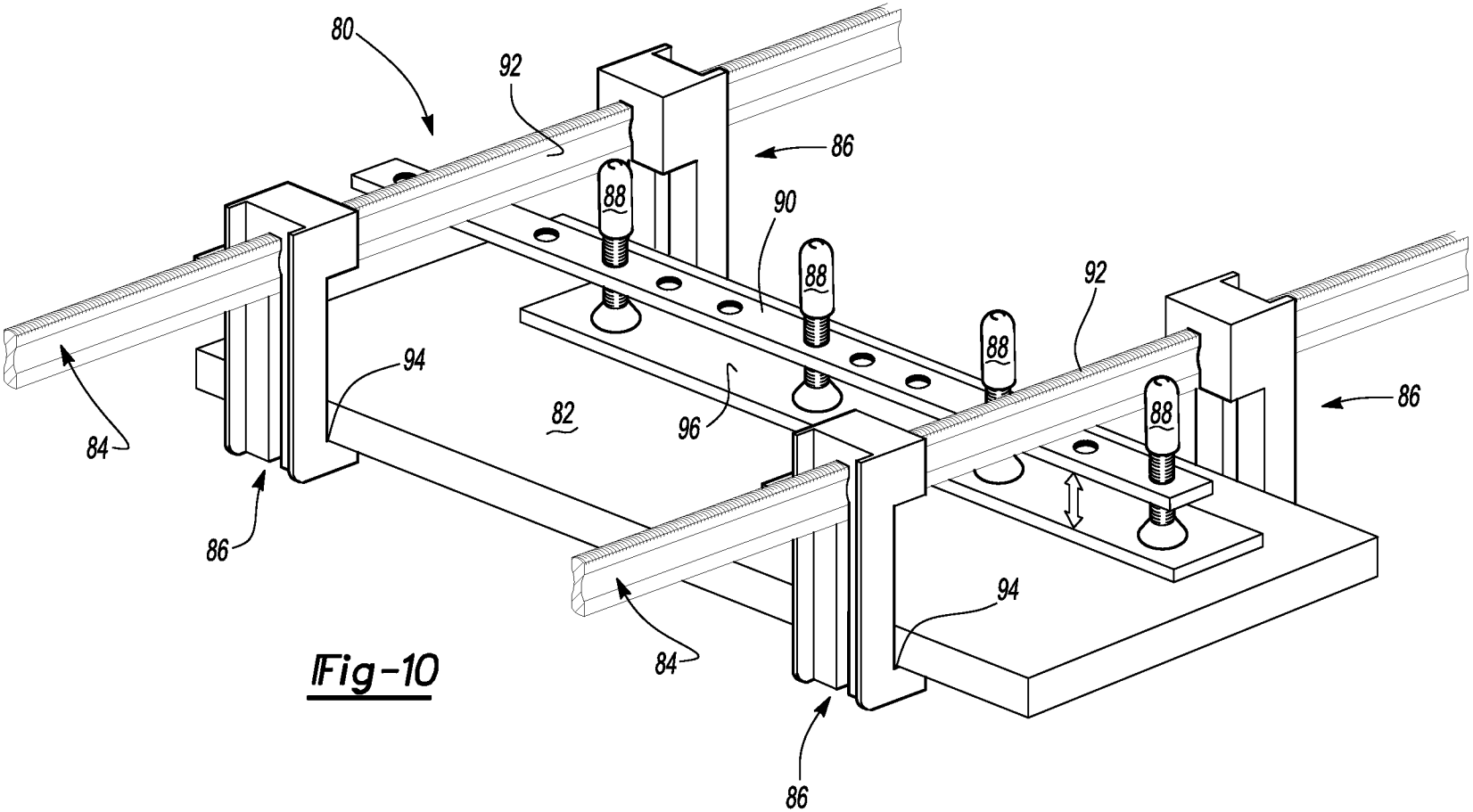
FIG. 10 illustrates an exemplary clamp system according to the teachings of the present invention.
Figure 11:
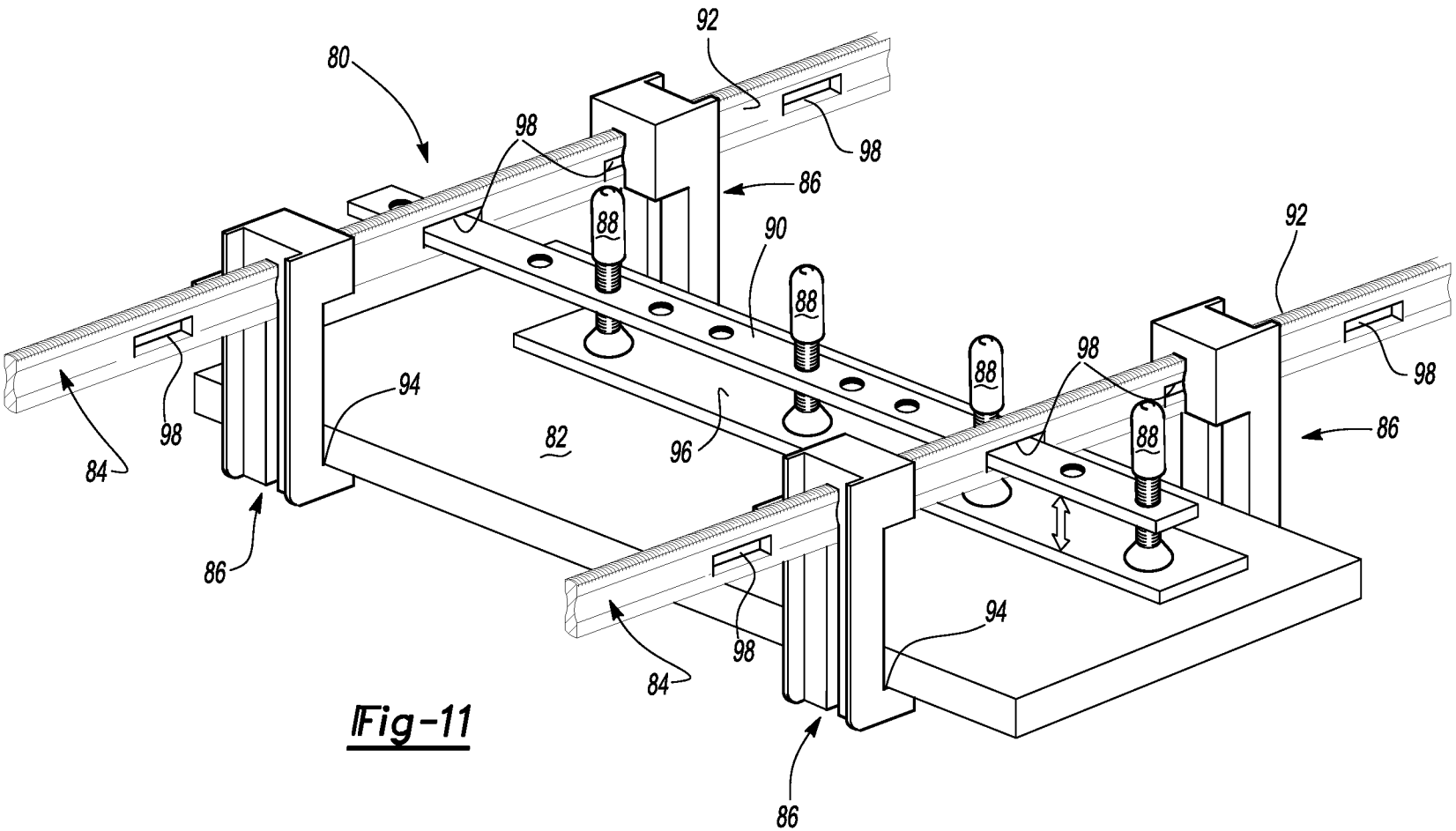
FIG. 11 illustrates another exemplary clamp system according to the teachings of the present invention.

Referring to FIGS. 10 and 11, the present invention further provides clamp systems 80 for joining multiple layers of a workpiece 82. The clamp systems 80 include two or more bar clamp assemblies 84 and workpiece support members 86, such as described herein of otherwise. The clamp systems 80 further includes a plurality of clamps 88, which in one exemplary embodiment comprises spindle clamps. The clamps 88 engage a cross member 90 which applies a load to guide rails 92 of the bar clamp assemblies 84 and to the workpiece 82, which is further applied to support surfaces 94 of the workpiece support members 86. In one particular exemplary embodiment, the clamp system 80 includes a load distribution member 96 for distributing loads generated by the clamps 88. In one particular configuration, as shown in FIG. 11, the guide rails 92 of the bar clamp assemblies 84 include engagement features for engaging the cross member 90 to prevent vertical and/or lateral movement of the cross member 90 with respect to the guide rails 92. In the configuration shown, the engagement features comprise openings 98 for receiving end portions of the cross members 90. It is contemplated that the guide rails 92 include multiple engagement features along the length thereof for using multiple cross members 90, clamps 88 and load distribution members 96 or otherwise positioning the cross members, clams and load distribution members to a desired region of the workpiece. Advantageously, this provides the ability to distribute compression throughout the entire workpiece or select regions, which is particularly desirous for larger workpieces.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A workpiece support members for a bar clamp assembly, comprising:

a pair of work piece support members each including:

a base;

a first finger extending from the base including a traverse portion, the first finger including a first workpiece abutment surface and a first workpiece support surface:

a second finger extending from the base including a traverse portion, the second finger including a second workpiece abutment surface and a second workpiece support surface; and an engagement feature with opening suitable for forming sliding engagement between the workpiece support member and a guide rail of a bar clamp assembly, wherein the first finger and second finger are disposed with respect to each other to form a slot extending from an exterior region of the work piece support member to the engagement feature.

2. The workpiece support member of claim 1, further comprising a first lip extending away from the first abutment surface and a second lip extending away from the second abutment surface, the first and second lips being disposed with respect to each other to form another slot adjacent the slot formed between the first finger and second finger.

3. The workpiece support member of claim 1, wherein the first workpiece abutment surface is generally perpendicular to the first workpiece support surface.

4. The workpiece support member of claim 1, wherein the engagement feature comprises a snap-fitting.

5. The workpiece support member of claim 1, wherein each of the work piece support members further include a clamp moveable with respect to the base, the clamps of the work piece support members being configured for engagement with a workpiece disposed therebetween.

6. The workpiece support member of claim 5, wherein the clamps comprise spindle clamps engaged with a corresponding base of the work piece support members.

7. The workpiece support member of claim 6, wherein the spindle clamps includes an abutment surface that is generally parallel with the first workpiece abutment surface.

8. The workpiece support member of claim 1, wherein at least one of the work piece support members further includes a third work piece support surface, the third work piece support surface being disposed generally above and generally parallel to the first workpiece support surface.

9. The workpiece support member of claim 8, wherein the at least one of the work piece support members further includes a fourth work piece support surface, the third work piece support being disposed generally above and generally parallel to the second workpiece support surface, wherein the third and fourth workpiece support surfaces are disposed on opposite sides of the base.

10. The workpiece support member of claim 1, wherein at least one of the work piece support members includes a first slot and a second slot, the first and second slots being disposed on opposite sides of the base.

11. A bar clamp assembly, comprising:

a bar clamp configured for engagement with a workpiece, the bar clamp including:

a guide rail extending along an axis between a first end and a second end;

a slide jaw disposed along the guide rail and a fixed jaw attached to the guide rail proximate the first or second end, the slide jaw being moveable with respect to the fixed jaw to compress a workpiece; and a first work piece support member disposed proximate the slide jaw and a second work piece support member disposed proximate the fixed jaw, each work piece support member including:

a base, a first finger extending from the base including a traverse portion, the first finger including a first workpiece abutment surface and a first workpiece support surface, a second finger extending from the base including a traverse portion, the second finger including a second workpiece abutment surface and a second workpiece support surface, and an engagement feature with opening suitable for forming sliding engagement between the workpiece support member and the guide rail, wherein the first finger and second finger are disposed with respect to each other to form a slot extending from an exterior region of the work piece support member to the engagement feature.

12. The bar clamp assembly of claim 11, further comprising a first clamp moveable with respect to the base of the first work piece support member, the first clamp being configured for engagement with a workpiece, and further comprising a second clamp moveable with respect to the base of the second work piece support member, the second clamp being configured for engagement with a workpiece.

13. The bar clamp assembly of claim 12, wherein the clamps of the first and second workpiece support members each comprise a threaded spindle clamp engaged with the corresponding base of the first and second workpiece support member.

14. The bar clamp assembly of claim 13, wherein the clamps of the first and second workpiece support members each include an abutment surface that is generally parallel with the workpiece abutment surfaces of the first and second workpiece support members.

15. The bar clamp assembly of claim 11, wherein each of the first and second workpiece support members include two additional workpiece support surfaces, the two additional workpiece support surfaces are disposed on opposite sides of the base, respectively.

16. A clamp system for joining multiple layers of a workpiece, the clamp system comprising:

a plurality of bar clamp assemblies, each of the plurality of bar clamp assemblies including:

a guide rail extending along an axis between a first end and a second end, a slide jaw disposed along the guide rail and a fixed jaw attached to the guide rail proximate the first or second end, the slide jaw being moveable with respect to the fixed jaw to compress a workpiece, a first workpiece support member disposed proximate the slide jaw and a second workpiece support member disposed proximate the fixed jaw, each of the first and second workpiece support members including a base having an engagement feature configured engagement with the guide rail and a pair of fingers extending from the base, the pair of fingers including a workpiece abutment surface and a workpiece support surface, one or more spindle clamps threadably engaged with a cross member that is engaged with the guide rails of the plurality of bar clamp assemblies, the one or more spindle clamps being moveable towards a workpiece that is supported by the support surfaces of the first and second workpiece support members.

17. The clamp system of claim 16, wherein the one or more spindle clamps comprise a plurality of spindle clamps.

18. The clamp system of claim 16, wherein the cross member engages and under portion of the guide rail.

19. The clamp system of claim 16, wherein each of the guide rails of the plurality of bar clamp assemblies include an opening for receiving the cross member.

20. The clamp system of claim 16, wherein each of the guide rails of the plurality of bar clamp assemblies include a plurality of openings each configured for receiving a cross member.

* * * * *